US005188472A

United States Patent [19]

Sgro

[11] Patent Number: 5,188,472

[45] Date of Patent: Feb. 23, 1993

[54] SHOE POLISH APPLICATION KIT

[76] Inventor: Albert J. Sgro, 24450 Union Cir., Beachwood, Ohio 44122

[21] Appl. No.: 755,565

[22] Filed: Sep. 5, 1991

[51] Int. Cl.[5] ..... A46B 11/00; A46B 17/00

[52] U.S. Cl. ..... 401/124; 401/125; 401/129; 401/191

[58] Field of Search ..... 401/118, 123-127, 401/129, 191, 269

[56] References Cited

U.S. PATENT DOCUMENTS

| | | | |
|---|---|---|---|
| 1,249,641 | 12/1917 | Lefrancois | 401/125 X |
| 2,654,110 | 10/1953 | Auten | 401/125 |
| 3,000,035 | 9/1961 | Harris et al. | 401/123 X |
| 3,131,410 | 5/1964 | Anderson et al. | 401/129 X |
| 3,224,572 | 12/1965 | Meyerhoefer | 401/125 X |
| 4,645,366 | 2/1987 | Frohn | 401/126 X |

FOREIGN PATENT DOCUMENTS

| | | | |
|---|---|---|---|
| 1940593 | 2/1971 | Fed. Rep. of Germany | 401/124 |
| 134349 | 1/1952 | Sweden | 401/125 |
| 447501 | 3/1968 | Switzerland | 401/127 |
| 1098454 | 1/1968 | United Kingdom | 401/126 |

*Primary Examiner*—Danton D. DeMille

*Attorney, Agent, or Firm*—Renner, Otto, Boisselle & Sklar

[57] ABSTRACT

The invention is an improved shoe care kit that simplifies the process of shoe polishing by virtue of consolidating conventional shoe shine components such as a brush applicator and/or polishing cloth into a convenient compact storage container. The shoe care kit is designed to be used in conjunction with a commercially produced shoe polish container by clamping the shoe care kit onto the polish container's lid to form an integral kit with the polish container. In the storage mode, the kit is an attractive compact unit and its own traveling or storage case ready to be used by the conventional shoe polishing method.

8 Claims, 2 Drawing Sheets

SHOE POLISH APPLICATION KIT

This invention relates generally as indicated to a shoe care kit and more particularly to a compact, easy to use, attractive kit which attaches to and becomes part of a commercially available shoe polish container.

BACKGROUND OF THE INVENTION

For many individuals, it is a relatively cumbersome and messy operation to obtain a quick shoe shine with conventional polishing and storage kits.

The conventional method is to first unscrew, or pry open, the polish container lid; place it down and then reach for the proper (color) brush applicator which has dried out polish residue from the previous application. When applying polish to shoes is completed, the brush applicator must be stored away in some sort of unprotective box, rack or shelf, and then one must retrieve the polish container and lid to be stored away separately. The search for the correct polish with the correct corresponding applicator brush becomes cumbersome and annoying.

There have been different designs that are in the marketplace that provide a shoe polish and dauber in one container such as seen in U.S. Pat. Nos. 3,224,572; 3,000,035; or 3,131,410. Some others use liquid or squeeze-out cream polish with a sponge type applicator with various disadvantages; and when the polish container is depleted the whole unit must be thrown out. There are those who still prefer the conventional method of polishing their shoes, i.e. with separate shoe polish with a bristle brush applicator and a buff, such as a polishing cloth.

SUMMARY OF THE INVENTION

The principal object of this invention is to remedy the above drawbacks in that the three basic conventional parts (a) commercially marketed paste polish in a pry-open can and/or cream polish in a glass jar with a screw lid; (b) bristle brush applicator and (c) buffing cloth are all housed in one simple consolidated compact and yet handsome storage container. Also, all three basic parts can be replaced without disposing of the entire kit.

The advantages of the present invention are:

(a) a shoe care kit which can be attached to commercially produced shoe polish containers and when the polish is depleted, the kit can be re-attached to a new replacement polish container without purchasing a whole new unit;

(b) to consolidate the polish container, the container lid, the conventional brush applicator, and a buffing cloth in one convenient compact storage unit;

(c) to provide a protective storage compartment for the brush applicator to keep the polish residue on the brush from drying out;

(d) to provide the kit components in one storage unit eliminating misplacing component parts;

(e) to provide an attractive compact unit minimizing storage space;

(f) to keep shoe polish and brush applicator together in one storage unit, with no need to search in order to match brush with color of polish;

(g) to provide a shoe care kit that is immediately ready to be used at all times; and (h) to improve cleanliness and appearance over the conventional method.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principle of the invention may be employed.

DETAILED DESCRIPTION OF THE PREFERRED EMBODIMENTS

Figure 1:
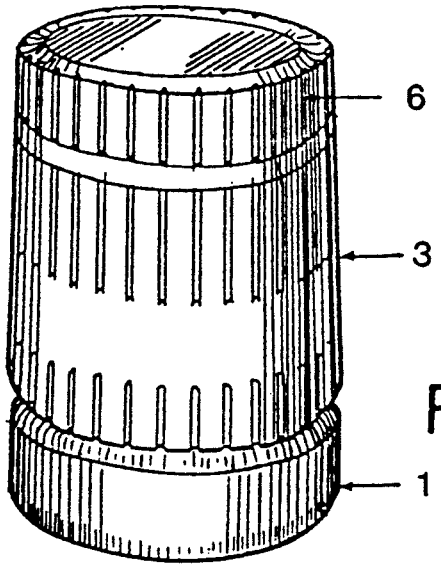
FIG. 1 is a perspective view in the storage mode showing the exterior of one form of the kit.

As seen in the embodiment of FIGS. 1–4, the bottom inside diameter of the cylindrical kit enclosure 3 is sized slightly smaller than the outside diameter of the polish container lid 2 and is of a somewhat resilient plastic material so as to clamp tightly over screw top container lid 2 to become an integral part of each other.

The glass polish container 1 and screw top lid 2 is a commercially marketed product and when polish is depleted a new purchased polish container 1 with lid 2 is replaced by reclamping the kit enclosure 3 onto the new container lid 2. The polish container 1 and lid 2 may alternatively be manufactured as part of the original shoe kit assembly rather than a separate marketed item.

The applicator brush handle 5 fits tightly into the open top rim of the kit enclosure 3 with a snap on action and being airtight prevents any polish left on the applicator brush from drying out.

The applicator brush handle 5 includes a removable cap or cover 6 and is designed to function as a buffing cloth storage compartment 7. Together with applicator brush 4, handle 5 can be lifted out of the kit enclosure 3 to form a complete handle with which to perform the application of polish to the shoe.

The applicator brush 4 is attached to the applicator brush handle 5 by the screw 8 which will allow the applicator brush 4 to be replaced when worn or damaged or to be interchanged with other brushes for different color polish.

Figure 3:
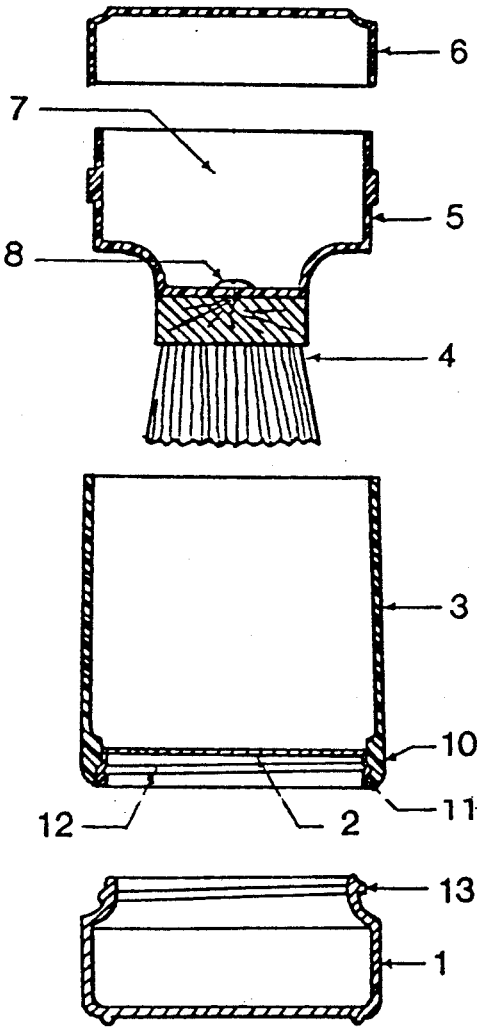
FIG. 3 is a vertical section of the kit showing the components exploded.
Figure 4:
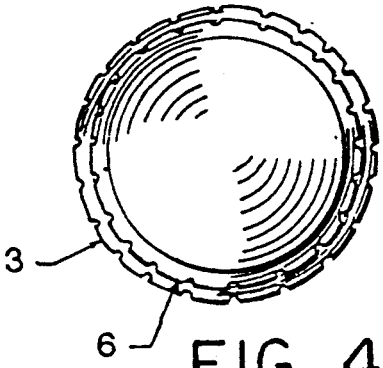
FIG. 4 is a top view of the kit looking down on FIG. 2.
Figure 2:
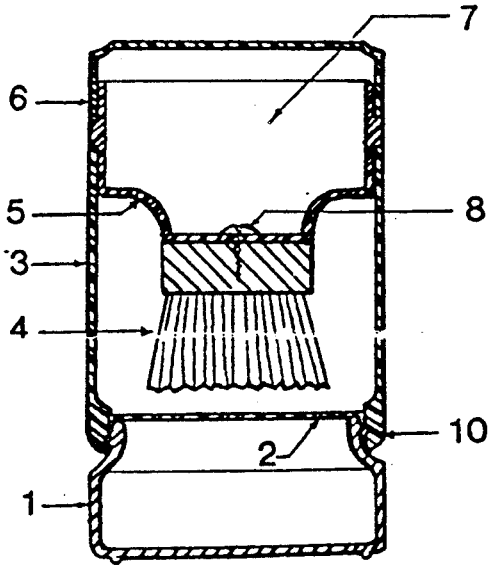
FIG. 2 is a vertical cross section of the kit showing all the assembled components in the storage mode.
Figure 5:
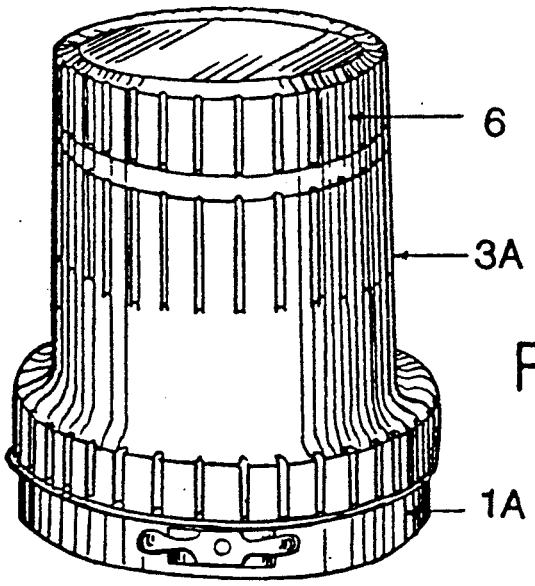
FIG. 5 is a perspective view of another form of kit.
Figure 8:
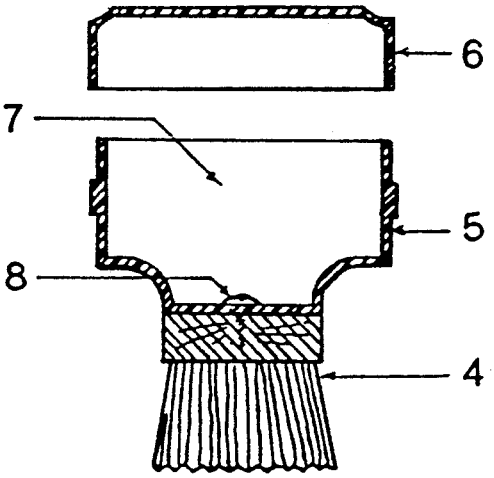
FIG. 8 is a top view of the kit looking down on FIG. 6.
Figure 8:
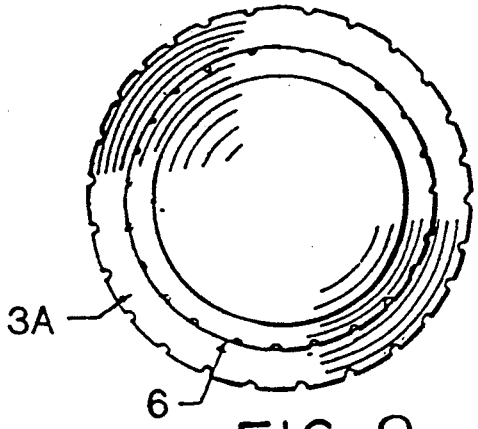
Figure 7:
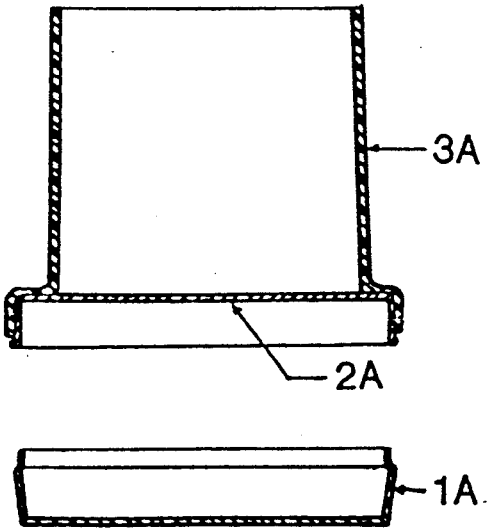
FIG. 7 is a vertical section showing the components exploded.
Figure 6:
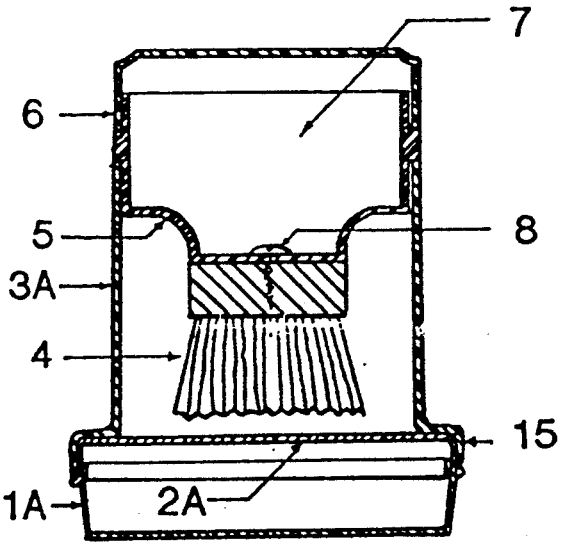
FIG. 6 is a vertical cross section of the kit of FIG. 5 in the assembled storage mode.

As seen in FIGS. 2 and 3 the lower end of the enclosure 3 is provided with an enlarged boss 10, the internal surface of which is provided with a threadform groove 11. The threadform groove 11 may either snap over or be screwed upon the threadform 12 in lid 2. The threadform 12 mates with the threadform 13 on the rim of the glass polish container 1.

Referring now to the embodiment of FIGS. 5–8, the bottom of the cylindrical kit closure 3A includes an expanded shoulder 15, the inside diameter of which is sized slightly smaller than the outside diameter of snap-on polish container lid 2A. The enclosure 3 is made of a somewhat resilient plastic material so as to clamp tightly over snap-on container lid 2A so that the two parts become as one.

The polish container 1A and snap-top lid 2A is a commercially marketed product and when polish is depleted a new purchased polish container 1A with lid 2A is replaced by reclamping the kit enclosure 3A onto the new container lid 2A. The polish container 1A and lid 2A may alternatively be manufactured as part of the original shoe kit assembly rather than a separate marketed item.

The applicator brush handle 5 fits tightly into the open top rim of the kit enclosure 3A with a snap on action and being airtight prevents any polish left on the applicator brush 4 from drying out.

The applicator brush handle 5 includes a removable cap or cover 6 and is designed to function as a buffing cloth storage compartment 7. Together with applicator brush 4, handle 5 can be lifted out of the kit enclosure 3A to form a complete handle with which to perform the application of polish to the shoe.

The applicator brush 4 is attached to the applicator brush handle 5 by the screw 8 which will allow the applicator brush 4 to be replaced when worn or damaged or to be interchanged with other brushes for different color polish.

The complete sequence of operation in its simplest form is:

(a) The shoe kit enclosure 3 or 3A now being an integral part of polish container lid 2 or 2A is removed from the polish container 1 or 1A.

(b) The applicator brush handle 5 is removed from kit enclosure 3 or 3A and polish is applied to applicator brush 4 from the open container 1 or 1A and then applied to shoes in the conventional manner.

(c) The applicator brush handle 5 is then snapped back into the kit enclosure 3 or 3A and the kit enclosure 3 or 3A with attached lid 2 or 2A respectively is replaced onto polish container 1 or 1A, completing the application of polish to shoes.

(d) If a buffing cloth is to be used (other than alternative equipment such as electric buffer or hand bristle brush) the cover 6 is removed from the compartment 7 of applicator brush handle 5 for access to a fold up buffing cloth for buffing of shoes.

(e) Upon completion of buffing, the buffing cloth is folded and placed back into compartment 7, and cover 6 is snapped back onto applicator brush handle 5 and stored until used again.

What is claimed is:

1. A shoe care kit comprising a cylindrical enclosure one end of which is adapted to clamp over the lid of a conventional shoe polish container and become as one therewith, a hollow brush applicator handle having a bottom and a cylindrical exterior wall extending upwardly therefrom forming a container for a shoe buffing implement, and the lower portion of the cylindrical exterior wall adapted to close the opposite end of said enclosure, and a removable cover on said handle including a cover cylindrical wall which in combination with the handle cylindrical wall is adapted to be gripped by the hand of the user and adapted to enclose within said handle said shoe buffing implement said handle and cover forming a cylindrical continuation of said enclosure, said handle and cover having a telescoping fit with each other, and said handle and cylindrical enclosure also having a telescoping fit with each other, to form such cylindrical continuation.

2. A kit as set forth in claim 1 wherein said handle seats tightly on said enclosure to form with the polish container lid an airtight enclosure for the brush.

3. A kit as set forth in claim 2 wherein said cover fits tightly on said handle to form an airtight enclosure for such buffing implement.

4. A kit as set forth in claim 1 wherein said brush is circular.

5. A kit as set forth in claim 1 wherein said brush is removable from said handle for easy replacement.

6. A kit as set forth in claim 5 including a screw removably holding said brush to said handle.

7. A kit as set forth in claim 1 wherein said enclosure includes a boss with an interior groove adapted to snap over or screw on a threaded lid for a polish container.

8. A kit as set forth in claim 1 includes a shoulder adapted to fit tightly over a pry-open lid of a shoe polish container.

* * * * *